US008240473B2

(12) United States Patent
Van Patten

(10) Patent No.: US 8,240,473 B2
(45) Date of Patent: Aug. 14, 2012

(54) HEADLINER PACKAGING SYSTEM WITH HINGED CLAMP

(75) Inventor: Michael Van Patten, Dayton, OH (US)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 12/342,391

(22) Filed: Dec. 23, 2008

(65) Prior Publication Data

US 2010/0156147 A1 Jun. 24, 2010

(51) Int. Cl.
*B65D 85/48* (2006.01)

(52) U.S. Cl. ..... 206/448; 206/451; 206/494

(58) Field of Classification Search ..... 206/448, 206/449, 451, 452, 454, 521, 523, 583, 594, 206/321, 325, 335; 211/8; 248/62, 689; 410/38–40; 296/214
See application file for complete search history.

(56) References Cited

U.S. PATENT DOCUMENTS

| | | | | | |
|---|---|---|---|---|---|
| 1,463,512 | A | | 7/1923 | Leach | |
| 2,806,592 | A | | 9/1957 | Hatfield | |
| 3,044,615 | A | | 7/1962 | Richardson | |
| 3,147,860 | A | | 9/1964 | Kean, Sr. et al. | |
| 3,389,785 | A | | 6/1968 | Lidgard | |
| 3,537,150 | A | | 11/1970 | Emberson | |
| 3,568,264 | A | | 3/1971 | Crist et al. | |
| 4,089,087 | A | | 5/1978 | Heitman | |
| 4,172,918 | A | | 10/1979 | Doerer | |
| 4,238,063 | A | * | 12/1980 | O'Dair | 206/315.1 |
| 4,312,467 | A | * | 1/1982 | Kulwin | 224/315 |
| 4,693,097 | A | * | 9/1987 | Rivera | 70/18 |
| 5,060,810 | A | * | 10/1991 | Jones | 211/59.4 |
| 5,154,310 | A | * | 10/1992 | Massey | 206/451 |
| 5,360,199 | A | * | 11/1994 | Speier | 254/129 |
| 5,667,072 | A | | 9/1997 | Chang | |
| 5,927,050 | A | | 7/1999 | Houck et al. | |
| 6,126,002 | A | | 10/2000 | Brown et al. | |
| 6,154,927 | A | | 12/2000 | Oi et al. | |
| 6,606,769 | B1 | * | 8/2003 | Harris | 224/180 |
| 6,752,271 | B2 | * | 6/2004 | Allison | 206/448 |
| 6,880,702 | B1 | * | 4/2005 | Colorado | 206/388 |
| 6,886,692 | B2 | | 5/2005 | Allison | |
| 7,080,735 | B2 | | 7/2006 | Allison | |
| 7,159,715 | B2 | | 1/2007 | Cornelius et al. | |

(Continued)

OTHER PUBLICATIONS

Office Action (Final), mailed Mar. 10, 2011, for U.S. Appl. No. 12/342,411, filed Dec. 23, 2008, entitled "Headliner Packaging System with Quick Release Mechanism," Michael Van Patten, inventor.

(Continued)

*Primary Examiner* — Luan K Bui
(74) *Attorney, Agent, or Firm* — McDermott Will & Emery LLP

(57) ABSTRACT

A headliner packaging may be configured to package a headliner having a surface and a width. The system may include one or more elongated clamps. Each elongated clamp may be configured to releasable secure the headliner by applying clamping force to an area on the surface of the headliner. Each elongated clamp may have a length that exceeds the width of the headliner. Each elongated clamp may have a hinge on one end of the elongated clamp which is configured to allow the elongated clamp to rotatably swing into an open position to receive the headliner and to rotatably swing into a closed position to lock the headliner securely within the elongated clamp. The packaging system may be configured to package an article other than a headliner.

13 Claims, 6 Drawing Sheets

U.S. PATENT DOCUMENTS

| | | | | |
|---|---|---|---|---|
| 7,533,771 | B2 | 5/2009 | Allison | |
| 7,766,168 | B2 | 8/2010 | Thrapp et al. | |
| 7,784,613 | B2 | 8/2010 | Angeletti et al. | |
| 2004/0060842 | A1 | 4/2004 | Gholston | |
| 2004/0129589 | A1 | 7/2004 | Tucker et al. | |
| 2006/0267386 | A1 | 11/2006 | Nakhla et al. | |
| 2008/0053856 | A1 | 3/2008 | Allison | |
| 2008/0264819 | A1* | 10/2008 | McDowell | 206/454 |

OTHER PUBLICATIONS

Advisory Action, mailed Apr. 7, 2011, for U.S. Appl. No. 12/342,403, filed Dec. 23, 2008, entitled "Headliner Packaging System for Headliner Having Non-Planar Surface," Michael Van Patten, inventor.

Non-Final Office Action, mailed Jul. 13, 2011, for U.S. Appl. No. 12/342,403, filed Dec. 23, 2008, entitled "Headliner Packaging System Having Non-Planar Surface."

Non-Final Office Action, dated Sep. 22, 2011, for U.S. Appl. No. 12/342,411, filed Dec. 23, 2008, entitled "Headliner Packaging System With Quick Release Mechanism."

Final Office Action, dated Feb. 2, 2012, for U.S. Appl. No. 12/342,403, filed Dec. 23, 2008, entitled "Headliner Packaging System for Headliner Having Non-Planar Surface."

Final Office Action, dated Feb. 9, 2012, for U.S. Appl. No. 12/342,411, filed Dec. 23, 2008, entitled "Headliner Packaging System With Quick Release Mechanism."

U.S. Appl. No. 12/342,403, filed Dec. 23, 2008. Office Action, mailed Jun. 23, 2010.

U.S. Appl. No. 12/342,411, filed Dec. 23, 2008. Office Action, mailed Oct. 1, 2010.

U.S. Appl. No. 12/342,403, filed, Dec. 23, 2008. Office Action, mailed Dec. 10, 2010.

Final Office Action, dated May 24, 2012, for U.S. Appl. No. 12/342,403, filed, Dec. 23, 2008, entitled "Headliner Packaging System for Headliner Having Non-Planar Surface."

* cited by examiner

HEADLINER PACKAGING SYSTEM WITH HINGED CLAMP

CROSS-REFERENCE TO RELATED APPLICATION(S)

This application is related to U.S. Pat. No. 6,752,271, entitled "Windshield Packaging System Using Synergistic Clamp Jaw Components," issued Jun. 22, 2004, U.S. Pat. No. 6,789,674, entitled "Windshield Packaging System Using Pressure-Regulated Clamps," issued Sep. 14, 2004, U.S. Pat. No. 6,886,692, entitled "Windshield Packaging System Using Corrugated Box with Horizontally-Running Flute," issued May 3, 2005, U.S. Pat. No. 7,080,735, entitled "Windshield Packaging System Using Corrugated Box with Horizontally-Running Flute," issued Jul. 25, 2006, U.S. patent application Ser. No. 11/279,533 entitled "Windshield Packaging System using Corrugated Box with Horizontally-Running Flute," filed Apr. 12, 2006, and U.S. patent application Ser. No. 11/932,277 entitled "Packaging System Using Pressure-Regulated Clamps with Synergistic Clamp Jaw Components," filed Oct. 31, 2007.

The entire content of each and every one of the applications and patents identified above is incorporated herein by reference.

BACKGROUND

1. Technical Field

This application relates to packaging systems, including packaging systems for vehicle components, such as headliners.

2. Description of Related Art

The shipment of an article can result in damage to the article when the shipping container is impacted or otherwise jarred. Fragile articles may be particularly prone to damage. Examples of such articles include certain vehicle components, such as the headliners which are installed below a vehicle roof.

Packaging an article such as a headliner for shipment may be difficult and time consuming. This may be particularly true when the packaging has several components.

It may also be difficult to manipulate large articles, such as headliners, between the various positions that may be necessary to package them within a multi-component shipping container.

There may also be other problems and concerns in connection with the packaging and shipment of articles, such as headliners.

SUMMARY

A headliner packaging system may be configured to package a headliner having a surface and a width. The headliner packaging system may include one or more elongated clamps. Each elongated clamp may be configured to releasable secure the headliner by applying clamping force to an area on the surface of the headliner. Each elongated clamp may have a length that exceeds the width of the headliner. Each elongated clamp may have a hinge on one end of the elongated clamp which is configured to allow the elongated clamp to rotatably swing into an open position to receive the headliner and to rotatably swing into a closed position to lock the headliner securely within the elongated clamp. The headliner packaging system may have a carton that is configured to house the elongated clamps and the headliner while locked within the elongated clamps. The carton may have walls. The elongated clamps may be configured to cause all portions of the headliner to be substantially spaced from the walls of the carton while the headliner is locked within the elongated clamps and the elongated clamps and the headliner are both within the carton.

The hinge may include two eyebolts. The hinge may include a link linking both of the eyebolts. Both of the eyebolts may have eyes that are closed. The link may be a carabiner.

The headliner packaging system may include a release mechanism on the other end of each clamp that allows the elongated clamp to move between a release position that releases the elongated clamp to receive the headliner and a lock position that locks the headliner securely within the elongated clamp.

There may be at least two elongated clamps. The elongated clamps may be attached to a common elongated clamp mount.

The headliner packaging system may include an elongated support brace attached to the elongated clamp mount that is configured to support a portion of the headliner, but not to clamp it.

Each elongated clamp may include two opposing jaws and at least one cushion positioned on each jaw to cushion contact between the jaw and the surface of the headliner.

Each elongated clamp may be configured to apply a substantially constant force to the headliner when the headliner is locked within the elongated clamp, notwithstanding variation in the amount of bending which the elongated clamp undergoes when swung into the closed position to lock the headliner.

The packaging system may be configured to package an article other than a headliner.

These, as well as other components, steps, features, objects, benefits, and advantages, will now become clear from a review of the following detailed description of illustrative embodiments, the accompanying drawings, and the claims.

BRIEF DESCRIPTION OF DRAWINGS

The drawings disclose illustrative embodiments. They do not set forth all embodiments. Other embodiments may be used in addition or instead. Details that may be apparent or unnecessary may be omitted to save space or for more effective illustration. Conversely, some embodiments may be practiced without all of the details that are disclosed. When the same numeral appears in different drawings, it is intended to refer to the same or like components or steps.

DETAILED DESCRIPTION OF ILLUSTRATIVE EMBODIMENTS

Illustrative embodiments are now discussed. Other embodiments may be used in addition or instead. Details that may be apparent or unnecessary may be omitted to save space or for a more effective presentation. Conversely, some embodiments may be practiced without all of the details that are disclosed.

Figure 1:
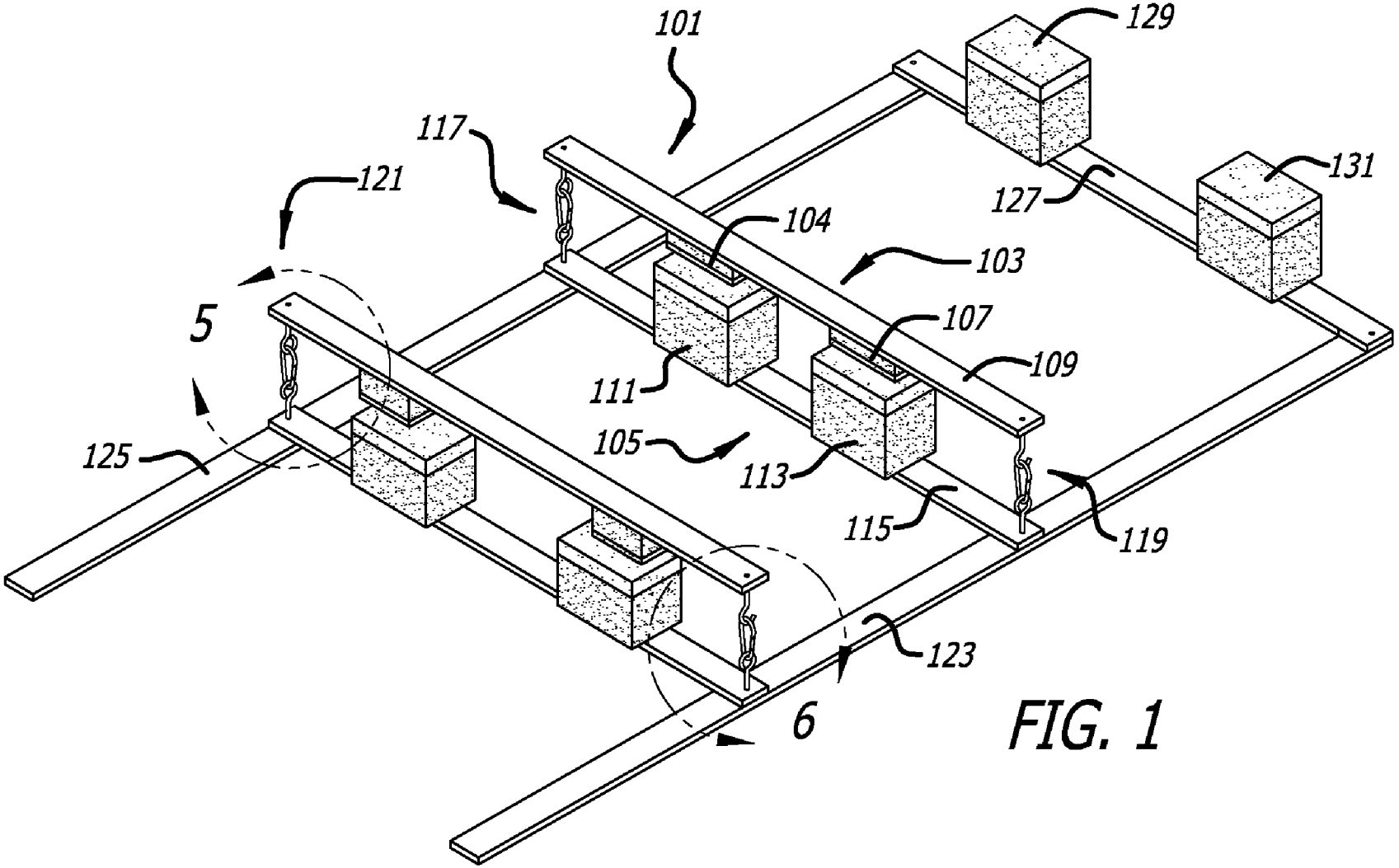
FIG. 1 illustrates a portion of a headliner packaging system.

FIG. 1 illustrates a portion of a headliner packaging system. As illustrated in FIG. 1, the headliner packaging system may include an elongated clamp 101 that may include a pair of opposing jaws 103 and 105. The opposing jaw 103 may include cushions 104 and 107 and a cross-brace 109. Similarly, the opposing jaw 105 may include cushions 111 and 113 and a cross-brace 115.

The elongated clamp 101 may include a hinge 117 attached at one end of the elongated clamp 101 and a quick release mechanism 119 attached to the other end of the elongated clamp 101.

The packaging system may have one or more additional elongated clamps which are completely the same as, or different in one or more ways from, the elongated clamp 101. An example is an elongated clamp 121.

The cross-braces which make up each elongated clamp, such as the cross-braces 109 and 115, may be of any shape and may be made of material. For example, they may elongated, may be substantially rectangular in cross-section, and may be made of wood or plastic. The cross-braces may be relatively stiff, while still permitting some degree of flexure without permanent deformation.

The packaging system may have one or more additional elongated clamps, each of which are completely the same as, or different in one or more ways from, the elongated clamp 101. An example is an elongated clamp 121.

Any number of cushions may be used in connection with each cross-brace, such as 0, 1, 2, 3, or a continuous cushion across all or most of the length of the cross-brace. Although the cushions are illustrated in FIG. 1 as being on both cross-braces of each elongated clamp, the cushions may be on only one cross-brace. When multiple cushions are used on a cross-brace, the position of each cushion on the cross-brace may vary from what is illustrated.

Corresponding sets of opposing cushions may be the same or different in size, shape, and/or composition. For example, larger cushions may be used on the bottom cross-braces, while smaller ones may be used on the top cross-braces, as illustrated in FIG. 1.

More details concerning the embodiment of the cushions which are illustrated in FIG. 1 are described below in connection with the discussion of FIG. 7.

The hinge 117 may be configured to allow the elongated clamp 101 to rotatably swing into an open position to receive a headliner and to rotatably swing into a closed position to lock the headliner securely within the elongated clamp 101. The hinge 117 may be attached to each of the opposing jaws 103 and 105. The hinge 117 may be attached to the opposing jaws 103 and/or 105 by any means, such as by one or more screws, nails, nuts and bolts, staples, glue, or any combination of these. More details concerning the embodiment of the hinge 117 which is illustrated in FIG. 1 are described below in connection with the discussion of FIG. 5.

The quick release mechanism 119 may be configured to have a release position that releases the elongated clamp 101 to receive a headliner and a lock position that locks the headliner securely within the elongated clamp 101. The quick release mechanism 119 may be configured to quickly move between the release and the lock positions in response to a single, non-repetitious movement of the quick release mechanism.

The quick release mechanism may be attached to the other end of the opposing jaws 103 and 105. It may be attached by any means, such as by one or more screws, staples, nails, nuts and bolts, glue, or any combination of these. More details concerning the embodiment of the quick release mechanism 119 which is illustrated in FIG. 1 are described below in connection with the discussion of FIG. 6.

The elongated clamps may be attached to one or more common elongated clamp mounts, such as elongated clamp mounts 123 and 125. The elongated clamp mounts 123 and 125 may be of any size or shape and may be made of any material. For example, they may have a rectangular cross-section and be made of wood or plastic. The elongated clamps may be attached to the elongated clamp mounts by any means. For example, they may be attached by one or more screws, nails, staples, nuts and bolts, glue, or by any combination of these.

The headliner packaging system may instead not have any elongated clamp mounts, in which case, each of the elongated clamps may be substantially unattached.

One or more elongated support braces, such as the elongated support brace 127, may be attached to the elongated clamp mounts, such as the elongated clamp mounts 123 and 125. The elongated support braces may be attached to the elongated clamp mounts by any means, such as by one or more nails, screws, staples, nuts and bolts, glue, or any combination of these.

The elongated support braces may have any size or shape and may be made of any material. For example, they may have a rectangular cross-section and be made of wood or plastic. Each of the elongated support braces may be configured to support a portion of the headliner, but not to clamp to it.

Each elongated support brace may or may not be used in conjunction with one or more cushions, such as cushions 129 and 131. Cushions 129 and 131 may be of any type or size. For example, they may be the same as or different from the cushion 113 or 107. The cushions 129 and/or 131 may or may not be attached to the elongated support brace 127. When attached, any means may be used, such as one or more nails, staples, nuts and bolts, screws, glue, or any combination of these.

Each elongated clamp in FIG. 1 is illustrated with an opposing jaw that is unattached to any elongated clamp mount. In an alternate embodiment, each of these may be attached to one or more additional elongated clamp mounts that may be of any size or shape or material, such as having a rectangular cross section and being made of wood or plastic. Each additional elongated clamp mount may be parallel to one of the elongated clamp mounts illustrated in FIG. 1.

Figure 2:
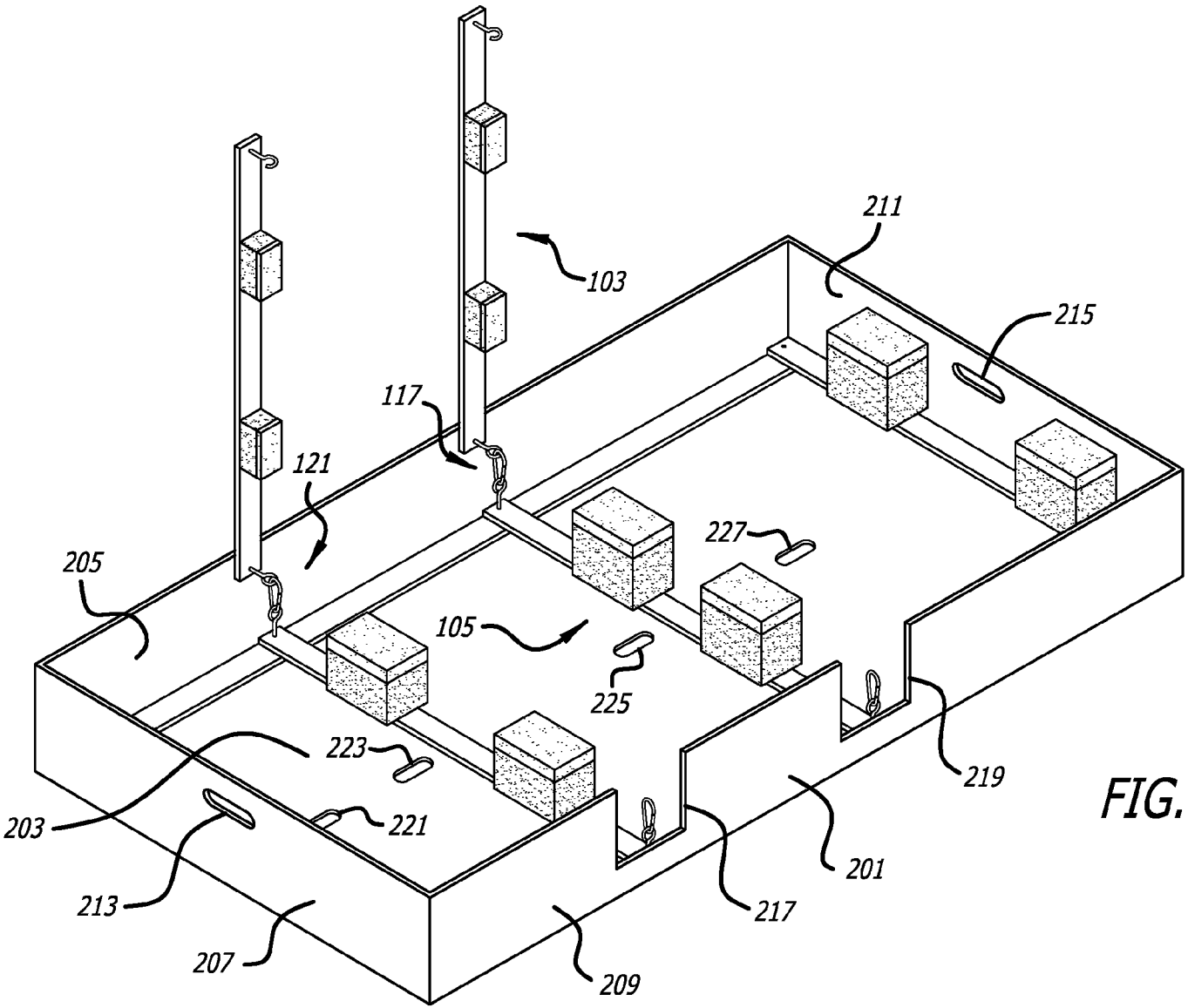
FIG. 2 illustrate the portion of the headliner packaging system illustrated in FIG. 1 inside of a portion of a carton and in an open position for receiving a headliner.

FIG. 2 illustrates the portion of the headliner packaging system illustrated in FIG. 1 inside of a portion of a carton and in an open position for receiving a headliner. As illustrated in FIG. 2, the elongated clamps 101 and 121 are in an open position, while each of their respective jaws are still hinged together at one end, such as by the hinge 117 in connection with the elongated clamp 101. As also illustrated in FIG. 2, the elongated clamps 101 and 121 may be placed while in their open position on a bottom wall 203 of a portion of a carton 201. As illustrated in FIG. 2, the portion of the carton 201 may have a bottom wall 203 and four sidewalls 205, 207, 209, and 211. The sidewalls 207 and 211 may have access holes 213 and 215, respectively, and the bottom wall may have access holes 221, 223, 225 and 227. The sidewall 209 may or may not have open ports 217 and 219 which, when present, may be sized and positioned so as to permit a person to reach through a port and move a quick release mechanism that is behind it between its release and lock positions. The ports 217 and 219 may have a different configuration, such as closed on top. More details concerning one such quick release mechanism are described below in connection with the discussion of FIG. 6.

As illustrated in FIG. 2, the portion of the carton 201 may have a length that is approximately equal to the length of the elongated clamp mounts 123 and 125. It may have a width that is approximately equal to the length of the elongated clamps, such as the length of the opposing jaw 103. It may have a height that is approximately equal to the height of the elongated clamps when clamping a headliner, as illustrated in FIG. 3 and as discussed in more detail below.

The portion of the carton 201 may be made of any material. For example, it may be made of paper or plastic. The material may be corrugated. The portion of the carton 201 may have flutes running in any direction. For example, the flutes on the bottom wall 203 may run parallel or perpendicular to the length of the elongated clamps. Similarly, the flutes on the sidewalls 205, 207, 209, and 211 may run parallel or perpendicular to the height of the portion of the carton 201.

Figure 3:
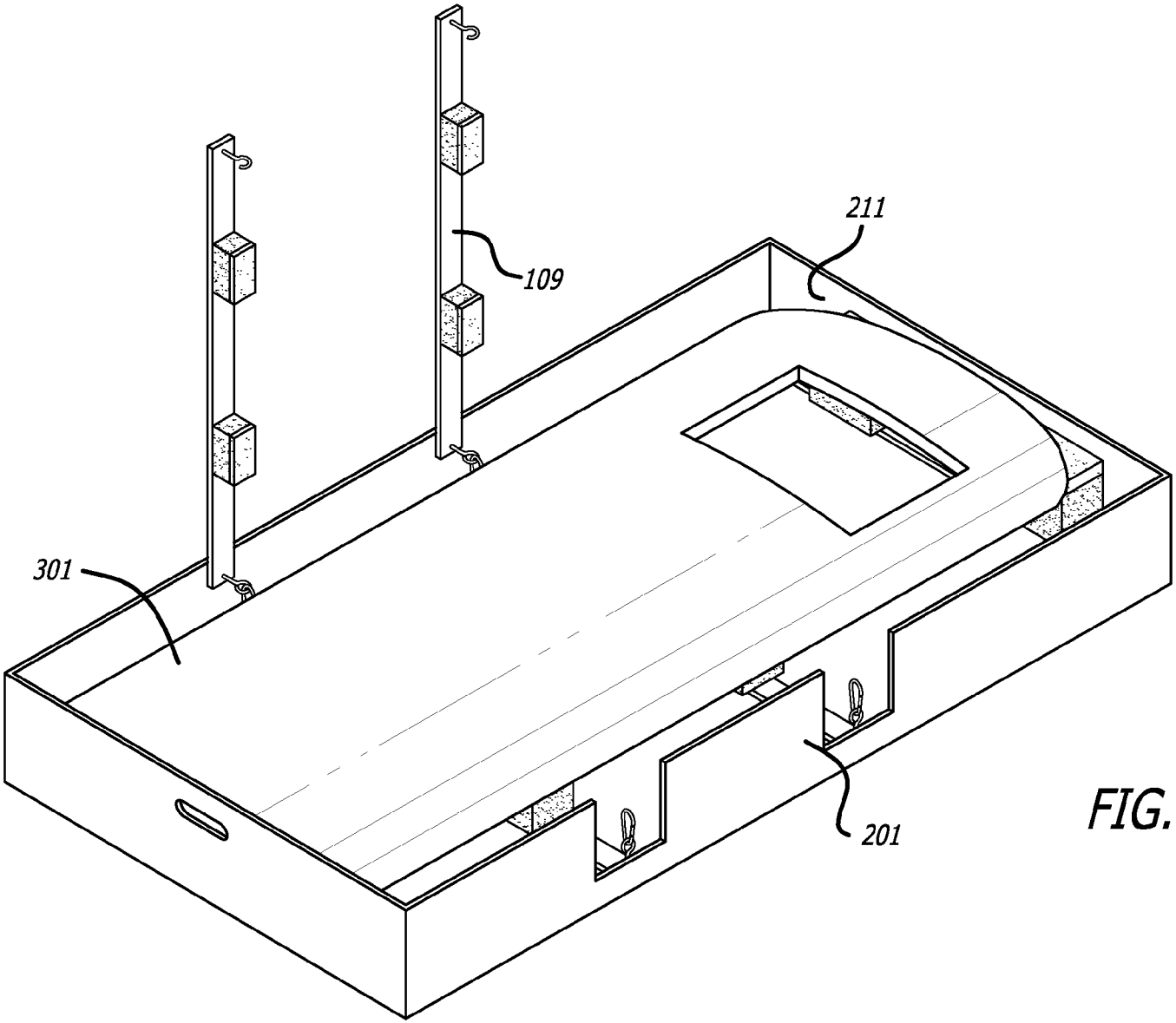
FIG. 3 illustrates the headliner packaging system illustrated in FIG. 2 after having received a headliner, while in the open position.

FIG. 3 illustrates the headliner packaging system illustrated in FIG. 2 after having received a headliner, while in the open position. As illustrated in FIG. 3, a headliner 301 may be rested on top of the various cushions that are illustrated in FIG. 1. As illustrated in FIG. 3, the headliner 301 may have a non-planar surface, meaning that it may have a surface that does not lie entirely within the same plane. In this case, the height of the various cushions may be such as to nevertheless simultaneously abut the headliner 301 when it is rested upon them, as illustrated in FIG. 3, without any gap in between the top of any cushion and the headliner 301. In other words, the heights of the various cushions may be customized to match the contour of the headliner 301 at the areas of contact and thus may vary from one another.

Although illustrated as receiving a headliner, the headliner packaging system in FIG. 2 may instead be configured to receive a different type of article, such a vehicle windshield. All of the discussions below may similarly be applicable to a headliner packaging system that is configured to receive an article other than a headliner.

Figure 4:
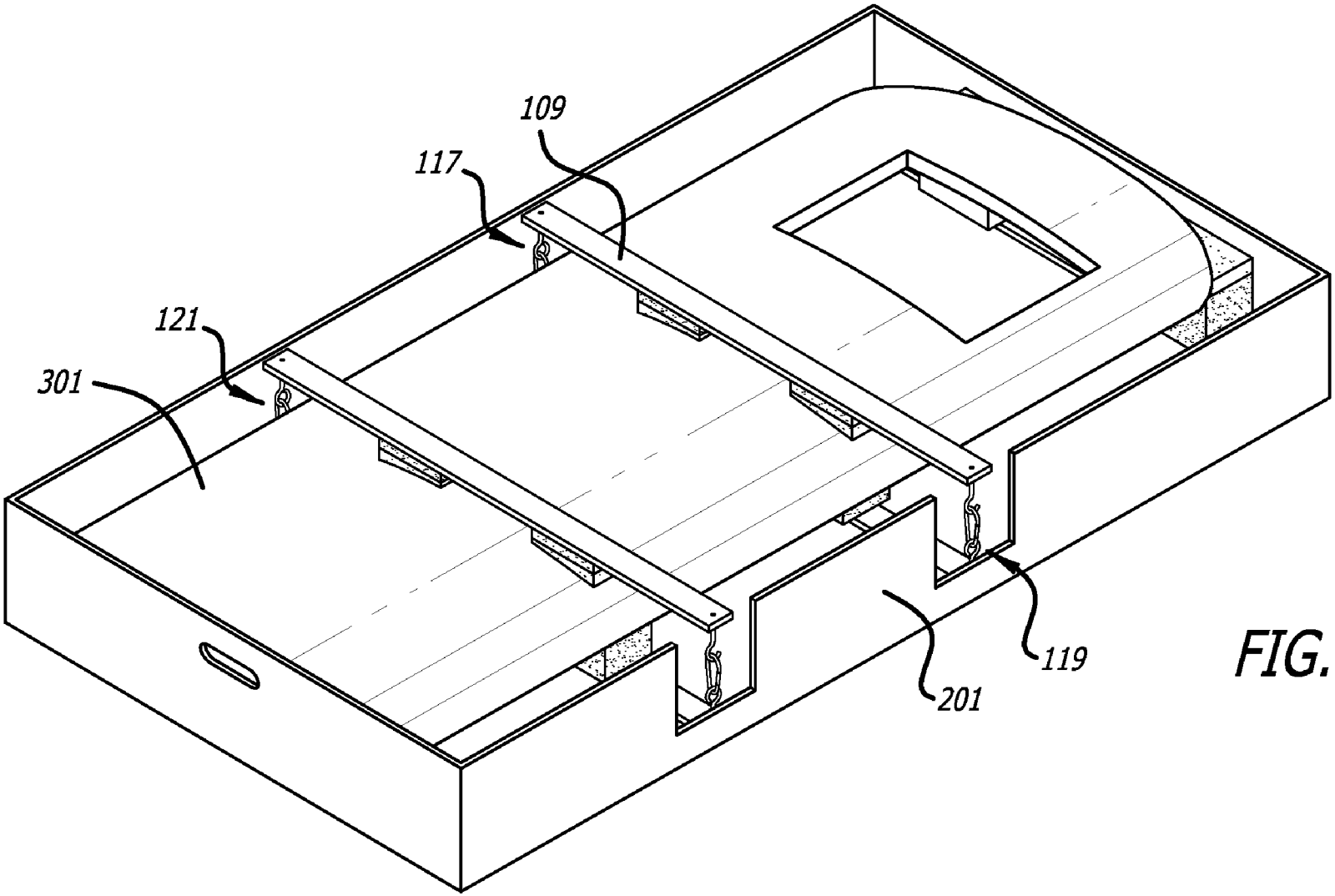
FIG. 4 illustrates the headliner packaging system illustrated in FIG. 3 after having received the headliner and while in a closed position.

FIG. 4 illustrates the headliner packaging system illustrated in FIG. 3 after having received the headliner and while in a closed position. As illustrated in FIG. 4, the opposing jaws of each clamp, such as the opposing jaw 103, may be swung from their open position to their closed position and pivot about their respected hinges, such as the hinge 117, in the process. The opposing jaws of each clamp may then be locked into their closed position by moving their respective quick release mechanisms, such as the quick release mechanism 119, from their release to lock positions. While in this lock position, the headliner 301 may be securely locked within the elongated jaws of each clamp with a degree of force which does not damage the headliner 301 and will not damage it during shipment.

While in the lock position, all portions of the headliner 301 may be substantially spaced from the sidewalls 205, 207, 209, and 211 of the portion of the carton 201, as well as from the bottom wall 203 of the portion of the carton 201.

In order to move the quick release mechanisms from their release position to their lock position, a person may reach through the port which is in front of the quick release mechanism with their fingers to effectuate this change in state, such as in connection with the port 217 and the quick release mechanism 119. In some embodiments, ports may not be provided and the release mechanism may not have a quick release. More details about this operation are described below in connection with the discussion of FIG. 6.

Each elongated clamp may be configured to apply a substantially constant force to the headliner 301 when the headliner 301 is locked within the elongated clamp, notwithstanding variation in the amount of bending which the elongated clamp may undergo when swung from its open to its closed position and when its associated quick release mechanism is moved from its release to its lock position, thus locking the headliner within the elongated clamp 101. The composition and shape of the opposing jaws 103 and 105 and their associated cushions may be selected to facilitate this functionality, such as by selecting material which resiliently compresses.

After the headliner 301 is securely locked within the elongated clamps, a top cover may be placed on top of the portion of the carton 201, thus completing the carton in which the headliner 301 is packaged. The top cover may have any shape, such as a shape that is complementary to the lower portion. The top cover may also have access holes and, if desired, access ports that are complementary to the ports 217 and 219. The top cover may be bound to the lower portion of the carton illustrated in FIG. 4. Any means may be used, such as tape, straps, glue, or any combination of these.

After shipment or before, the top cover may be removed, the quick release mechanism may be moved from its lock to release position, the elongated clamps may be moved from their closed to their open position, and the headliner 301 may be removed.

Figure 5:
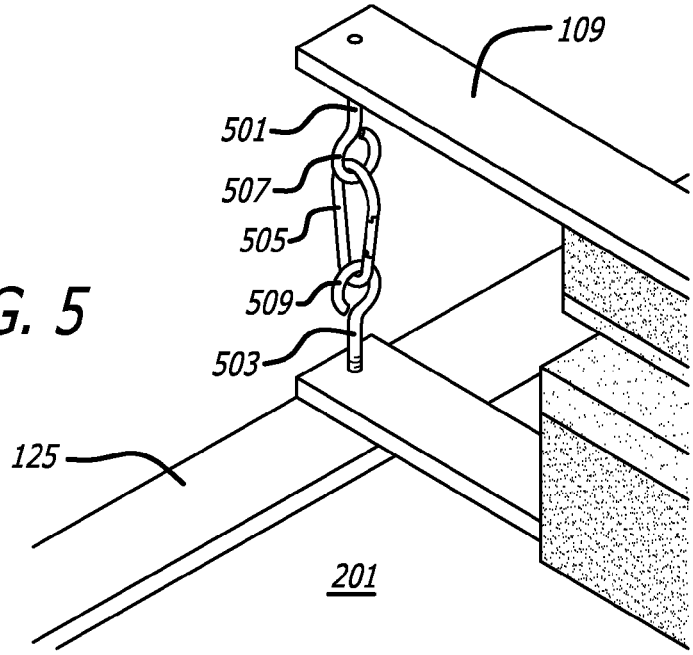
FIG. 5 is an enlarged view of a hinge that is part of the headliner packaging system illustrated in FIG. 2.

FIG. 5 is an enlarged view of a hinge that is part of the headliner packaging system illustrated in FIG. 2. As illustrated in FIG. 5, the hinge may include an eyebolt 501 attached to one of the opposing jaws, an eyebolt 503 attached to the other opposing jaw, and a carabiner 505 or other type of link linking the eyebolt 501 to the eyebolt 503 through their respective eyes 507 and 509. As illustrated in FIG. 5, the eyes 507 and 509 may both be closed. Instead, one or more of them may be open. In a still further embodiment, the eyes 507 and 509 may be linked directly together, without an intervening link, such as the carabiner 505.

The ends of the eyebolts 501 and 503 may be attached to their respective opposing jaw by any means. For example, these ends may be threaded and attached by a nut on the other side of the opposing jaw. The other side of the opposing jaw may be countersunk so that the nut may be flush with the outer surface of the other side of the opposing jaw, and the eyebolt may have a length such that no portion of it protrudes beyond this outer side.

Any other type of hinge may be used in addition or instead.

Figure 6:
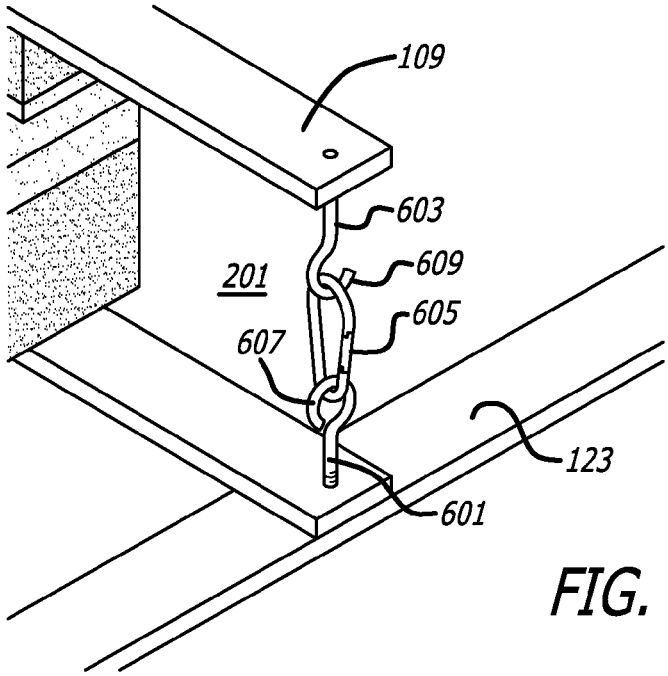
FIG. 6 is an enlarged view of a quick release mechanism that is part of the headliner packaging system illustrated in FIG. 2.

FIG. 6 is an enlarged view of a quick release mechanism that is part of the headliner packaging system illustrated in FIG. 2. As illustrated in FIG. 6, the quick release mechanism 119 may include an eyebolt 601 that is attached to the other end of the opposing jaw 103, another eyebolt 603 that is attached to the other opposing jaw 105, and a carabiner 605 or other type of link that links the eyes 607 and 609 of the eyebolts 601 and 603, respectively, together.

As illustrated in FIG. 6, the eye 609 of the eyebolt 603 may be an open eye, thus allowing the eye 609 to function as a hook which may be hooked to the carabiner 605. Hooking the open eye 609 to and from the carabiner 605 may be accomplished by squeezing the opposing jaws 103 and 105 together, thus causing them to move closer towards one another. While under this pressure, the free end of the carabiner 605 may be moved under the hook of the open eye 609. Thereafter, pressure on the opposing jaw 103 and 105 may be released, thus causing the quick release mechanism to lock the elongated clamp in its closed position. This process may be repeated for the other clamps. This process may later be repeated to unlock the headliner from each clamp, except that the free end of each carabiner may instead be moved away from the hook of its associated eyebolt.

As may now be apparent, the hooking and unhooking of each quick release mechanism may be accomplished with a single, non-repetitious, arch-like movement of one end of the carabiner, either to bring it under the hook of the eye of the eyebolt or to clear it from this hook. No repetitive rotation of a nut or bolt, for example, is required. After the opposing jaws of a clamp are squeezed together, a person may reach through the port that is in front of a carabiner with his fingers, such as the port 219 in connection with the carabiner 605, and move the free end of the carabiner to the needed position, either under the hook to lock the elongated clamp or away from the hook to release it. This may be easier than trying to squeeze ones fingers between the end of the jaw of a clamp and the wall of the carton.

Other types of quick release mechanism may be used in addition or instead.

Figure 7:
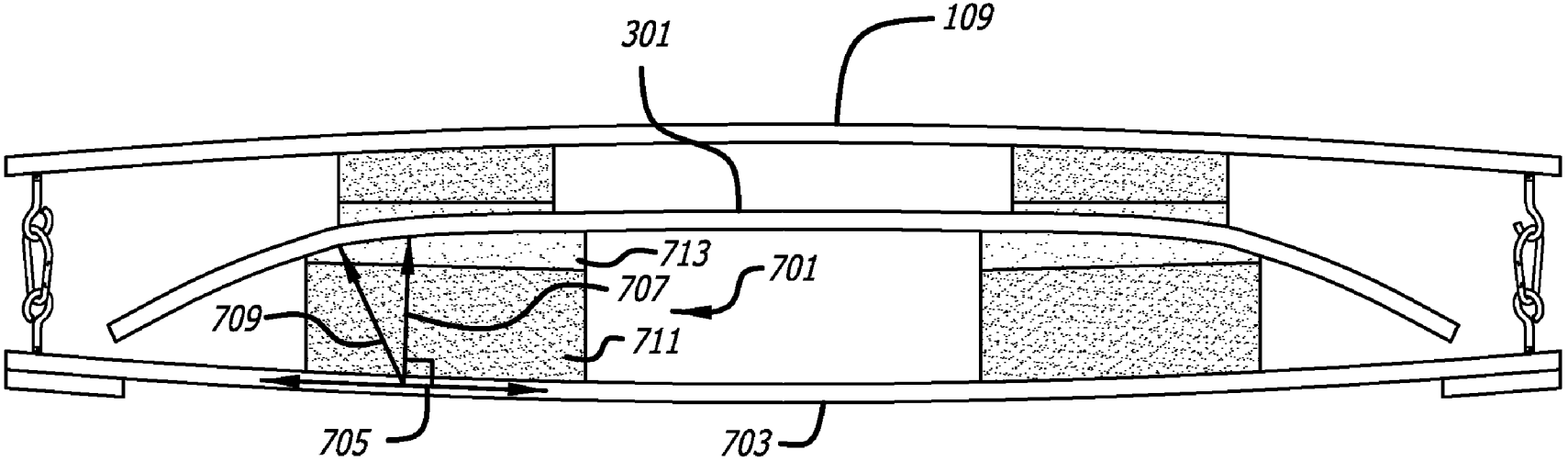
FIG. 7 is an enlarged view of cushions that are part of the headliner packaging system illustrated in FIG. 2.

FIG. 7 is an enlarged view of cushions that are part of the headliner packaging system illustrated in FIG. 2. As illustrated in FIG. 7, one or more of these cushions, such as a cushion 701, may be configured to releasably secure the headliner 301 by applying a force across a portion of a non-planar surface of the headliner 301. This application of force may be such that the force is substantially uniform throughout the area of the non-planar surface that engages the cushion, but in a direction that is not substantially perpendicular to the length of the elongated clamp, such as the length of one of the cross-braces 703.

The direction of the length of the cross-brace 703 is illustrated in FIG. 7 by a vector 705; the perpendicular to this length is illustrated by a vector 707; and the direction of force which is applied by the cushion 701 to an area of the non-planar surface of the headliner is illustrated by a vector 709. As illustrated in FIG. 7, the direction of the force as illustrated by the vector 709 is not substantially perpendicular to the length of the elongated clamp as illustrated by the vector 705. For example, it may deviate from the perpendicular by at least 5, 10, 20 or more degrees.

The size and composition of the cushions, such as the cushion 701, may be selected to facilitate the application of this uniform force throughout an area of the non-planar surface of the headliner in a direction that is not substantially perpendicular to the length of the cross-brace 703. For example, each cushion may be made of a volume of expanded polypropylene 711 abutting a volume of polyurethane 713. The polyurethane 713 may be configured to directly contact the area of the non-planar surface of the headliner 301, while the expanded polypropylene 711 may be configured not to directly contact the area of the non-planar surface but, instead, to be sandwiched between the polyurethane 713 and the cross-brace 703. The thickness of the polyurethane 713 may be less than half of the thickness of the expanded polypropylene 711, as also illustrated in FIG. 7.

The polyurethane 713 and the expanded polypropylene 711 may be of any density. For example, the polyurethane may be 1.6# polyurethane and the expanded polypropylene may be 0.9# expanded polypropylene.

The cushion or cushions on the opposing jaw may be the same or different. For example, they may be made of the same or different types of multiple material with the same or different densities and the same or different volumes. To compensate for the weight of the headliner 301, the height of the cushions beneath the headliner 301 may be substantially greater than the height of the cushions on top of the headliner.

The components, steps, features, objects, benefits and advantages that have been discussed are merely illustrative. None of them, nor the discussions relating to them, are intended to limit the scope of protection in any way. Numerous other embodiments are also contemplated. These include embodiments that have fewer, additional, and/or different components, steps, features, objects, benefits and advantages. These also include embodiments in which the components and/or steps are arranged and/or ordered differently.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

The phrase "means for" when used in a claim is intended to and should be interpreted to embrace the corresponding structures and materials that have been described and their equivalents. Similarly, the phrase "step for" when used in a claim embraces the corresponding acts that have been described and their equivalents. The absence of these phrases means that the claim is not intended to and should not be interpreted to be limited to any of the corresponding structures, materials, or acts or to their equivalents.

Nothing that has been stated or illustrated is intended or should be interpreted to cause a dedication of any component, step, feature, object, benefit, advantage, or equivalent to the public, regardless of whether it is recited in the claims.

The scope of protection is limited solely by the claims that now follow. That scope is intended and should be interpreted to be as broad as is consistent with the ordinary meaning of the language that is used in the claims when interpreted in light of this specification and the prosecution history that follows and to encompass all structural and functional equivalents.

The invention claimed is:

1. An article packaging system for packaging an article having a surface and a width, the packaging system comprising:

one or more elongated clamps, each configured to releasable secure the article by applying clamping force to an area on the surface of the article, each elongated clamp having:

a length that exceeds the width of the article; and a hinge on one end of the one or more elongated clamps that is configured to allow each of the one or more elongated clamps to rotatably swing into an open position to receive the article and to rotatably swing into a closed position to lock the article securely within the elongated clamp, the hinge including an eyebolt having an eye and a link connected to the eye of the eyebolt that is a carabiner; and a carton that is configured to house the one or more elongated clamps and the article while locked within the one or more elongated clamps, the carton having walls, the one or more elongated clamps being configured to cause all portions of the article to be substantially spaced from the walls of the carton while the article is locked within the one or more elongated clamps and the one or more elongated clamps and the article are both within the carton.

2. The article packaging system of claim 1 wherein the hinge includes two eyebolts.

3. The article packaging system of claim 2 wherein the carabiner is a link linking both of the eyebolts.

4. The article packaging system of claim 3 wherein both of the eyebolts have eyes that are closed.

5. The article packaging system of claim 1 further comprising a release mechanism on the other end of each clamp that allows the elongated clamp to move between a release position that enables the elongated clamp to receive the article and a lock position that locks the article securely within the elongated clamp.

6. The article packaging system of claim 1 wherein there are at least two of the one or more elongated clamps.

7. The article packaging system of claim 6 wherein the one or more elongated clamps are attached to a common elongated clamp mount.

8. The article packaging system of claim 7 further comprising an elongated support brace attached to the elongated clamp mount that is configured to support a portion of the article, but not attached to the clamps.

9. The article packaging system of claim 1 wherein each of the one or more elongated clamps includes two opposing jaws and at least one cushion positioned on each jaw to cushion contact between the jaw and the surface of the article.

10. The article packaging system of claim 1 wherein each of the one or more elongated clamps is configured to apply a substantially constant force to the article when the article is locked within the elongated clamp, notwithstanding variation in the amount of bending which the elongated clamp undergoes when swung into the closed position to lock the article.

11. The article packaging system of claim 1 wherein the article is a headliner.

12. An article packaging system for packaging an article having a surface and a width, the packaging system comprising:

an elongated clamp mount configured to attach to elongated clamps;

elongated clamps, each attached to the elongated clamp mount, configured to releasable secure the article by applying clamping force to an area on the surface of the article, and having:

a length that exceeds the width of the article; and a hinge on one end of the elongated clamp that is configured to allow the elongated clamp to rotatably swing into an open position to receive the article and to rotatably swing into a closed position to lock the article securely within the elongated clamp;

at least one support cushion attached to the elongated clamp mount that is configured to support a portion of the article, but not to clamp to the article, and that is not part of or attached to the elongated clamps; and a carton that is configured to house the elongated clamp mount, the elongated clamps, the at least one support cushion, and the article while locked within the elongated clamps, the carton having walls and being separate and distinct from the elongated clamp mount, the elongated clamps, and the at least one support cushion, the elongated clamps being configured to cause all portions of the article to be substantially spaced from the walls of the carton while the article is locked within the elongated clamps and the elongated clamps and the article are both within the carton.

13. The article packaging system of claim 12 wherein the article is a headliner.

* * * * *